US008319447B2

(12) United States Patent
Hasegawa et al.

(10) Patent No.: US 8,319,447 B2
(45) Date of Patent: Nov. 27, 2012

(54) HID LAMP BALLAST WITH MULTI-PHASE OPERATION BASED ON A DETECTED LAMP ILLUMINATION STATE

(75) Inventors: Junichi Hasegawa, Kashiwara (JP); Takeshi Goriki, Yawata (JP)

(73) Assignee: Panasonic Corporation, Osaka (JP)

( * ) Notice: Subject to any disclaimer, the term of this patent is extended or adjusted under 35 U.S.C. 154(b) by 185 days.

(21) Appl. No.: 12/843,747

(22) Filed: Jul. 26, 2010

(65) Prior Publication Data

US 2011/0018453 A1 Jan. 27, 2011

(30) Foreign Application Priority Data

Jul. 24, 2009 (JP) ..... 2009-173692

(51) Int. Cl.
*H05B 41/36* (2006.01)

(52) U.S. Cl. ..... 315/224; 315/349; 315/308

(58) Field of Classification Search ..... 315/291, 315/293, 307, 308, 326, 349, 352, 353
See application file for complete search history.

(56) References Cited

U.S. PATENT DOCUMENTS 6,965,204 B2 11/2005 Langeslag
7,365,497 B2 * 4/2008 Fukuda et al. ..... 315/209 T
* cited by examiner

*Primary Examiner* — Don Le
(74) *Attorney, Agent, or Firm* — Waddey & Patterson, P.C.; Mark J. Patterson; Gary L. Montle

(57) ABSTRACT

An electronic ballast is provided for improved startup and powering of a high pressure discharge lamp. The ballast includes an inverter, a starting circuit for generating a high voltage to ignite the lamp, a controller for controlling an operating frequency of the inverter from startup to steady-state lamp operation, and a lamp output detection circuit. The controller controls the inverter in association with one or more of a first phase in which the starting circuit generates the high voltage and causes dielectric breakdown between the lamp electrodes, a second phase in which an electrode heating operation is performed after dielectric breakdown and a third phase in which steady-state operation of the lamp is performed. A lamp output determination is performed at a predetermined time before shifting to the third phase, and upon determining that the lamp is ignited the second phase is inserted.

16 Claims, 13 Drawing Sheets

HID LAMP BALLAST WITH MULTI-PHASE OPERATION BASED ON A DETECTED LAMP ILLUMINATION STATE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: Japan Patent Application No. 2009-173692, filed Jul. 24, 2009.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a high pressure discharge lamp ballast for a high-intensity, high-pressure discharge lamp such as a high-pressure mercury lamp or a metal halide lamp, and an illumination system including an illumination fixture which makes use of the high pressure discharge lamp ballast.

FIG. 10 shows a conventional example of an electronic high pressure discharge lamp ballast. A lighting circuit 1 may be defined as including a full-wave rectifying circuit DB, a step-up chopper circuit 11 (also referred to herein as a power factor correction circuit 11, or "PFC" 11) and a polarity inverting step-down chopper circuit 12 (also referred to herein as a resonant inverter circuit 12 or merely "inverter" 12). The inverter 12 is configured by connecting an inductor L2 in series with a load and a capacitor C3 in parallel with the load to outputs of switching elements Q3 to Q6 arranged in a full bridge configuration. The switching elements Q3 to Q6 are controlled by a switching control circuit 4 (also referred to herein more generally as a "controller" 4) and operate so as to produce a high-frequency output at startup/ignition and a low-frequency rectangular output during steady-state operation. The ballast further includes a starting circuit 2 formed of a resonance boost circuit inserted between an output of the inverter 12 and a high-pressure discharge lamp DL.

FIG. 11 schematically shows an example of an operational waveform in association with the circuit of FIG. 10. In the figure, Vla refers to a lamp voltage applied across the high-pressure discharge lamp DL and Ila refers to a lamp current flowing to the high-pressure discharge lamp DL. In an A1 phase defining a starting period and further associated with a first mode of operation for the ballast, a high-frequency high voltage is applied across the high-pressure discharge lamp DL by a resonance boost effect of the starting circuit 2. When a dielectric breakdown occurs between lamp electrodes in the A1 phase, the lamp current Ila starts to flow. At this time, the flowing lamp current I1*a* has relatively small amplitude. This current maintains glow discharge and thereby functions to heat the electrodes. After a predetermined period of time associated with the A1 phase, operation shifts to an A3 phase further defining a steady-state lighting period, and a low-frequency rectangular wave voltage is applied to the high-pressure discharge lamp DL.

FIG. 12 also shows an example of the operational waveform in association with the circuit of FIG. 10 in greater detail. First, in the A1 phase during startup, since a pair of the switching elements Q3, Q6 and a pair of the switching elements Q4, Q5 in the inverter 12 are alternately turned on/off with a high frequency of a resonance frequency (or an integral sub-multiple thereof), the starting circuit 2 formed of the resonance boost circuitry generates a high-frequency voltage of high amplitude, thereby causing dielectric breakdown between the electrodes of the high-pressure discharge lamp DL. When dielectric breakdown occurs between the electrodes in the A1 phase the lamp current Ila starts to flow, but an operational frequency fa1 remains the same as before the dielectric breakdown, and the amplitude of the lamp current Ila is relatively small.

When the control circuit after the predetermined period of time shifts from the A1 phase to the A3 phase for steady-state lighting operation, the switching elements Q3, Q4 are alternately turned on/off with a low frequency. Then, by turning on/off the switching element Q6 with a high frequency while the switching element Q3 is turned on and turning on/off the switching element Q5 with a high frequency while the switching element Q4 is turned on, a low-frequency rectangular wave AC voltage is supplied to the high-pressure discharge lamp DL. In the A3 phase a lamp output detection circuit 3 detects the lamp voltage Vla, and in response to a detection signal provided by the detection circuit 3, the switching control circuit 4 controls an ON-time for the switching elements Q5, Q6 so as to produce an appropriate lamp current Ila. Thus, a DC power source Vdc is converted into a rectangular wave AC voltage which is necessary for stable lighting of the high-pressure discharge lamp DL, and the AC voltage is applied to the high-pressure discharge lamp La.

Therefore, in a manner previously known in the art a high voltage is generated from startup to steady-state operation of the high-pressure discharge lamp DL, thereby switching between the A1 phase as an ignition phase for generating dielectric breakdown between the electrodes and the A3 phase as a steady-state phase for maintaining arc discharge.

FIG. 13 shows transition of the lamp voltage V1*a* and an operating frequency f after powering on in another control example as previously known in the art. In the figure, 0 to t2 refers to the A1 phase, t2 to t3 refers to the A2 phase and t3 and thereafter refers to the A3 phase. In the control example shown, when the operating frequency is gradually lowered after power-on and reaches a frequency which is one third of the resonance frequency of a resonance circuit (fo/3) at the time t1, the frequency is fixed and a high-frequency generating operation using a resonance effect is maintained up to the time t2. After that, in periods of t2 to t2' and t2' to t3, the operating frequency is lowered in a stepped manner. Thereby, as shown in FIG. 14, the lamp current Ila can be increased as the operating frequency f decreases, and thus the electrodes of the high-pressure discharge lamp can be sufficiently heated. Although the same operation is performed as is shown for example in FIG. 12 from the time t3 and thereafter, since the electrodes are sufficiently heated the lamp is less likely in this case to be undesirably extinguished.

The example as shown and previously known in the art has the following problems. As shown in FIG. 11 and FIG. 12, it is desired that when the high-pressure discharge lamp is ignited in the A1 phase, the high-pressure discharge lamp shifts from glow discharge to arc discharge in the remaining A1 phase. However, since the current amplitude is small, the A1 phase shifts to the A3 phase before the electrodes of the high-pressure discharge lamp are sufficiently heated. As a result the discharge lamp may be easily extinguished and remain unlit. Furthermore, since the timing of dielectric breakdown of the high-pressure discharge lamp varies depending on the state of the high-pressure discharge lamp (i.e., a characteristic of the lamp output), a remaining electrode heating time in the A1 phase after dielectric breakdown also becomes irregular, and the high-pressure discharge lamp may easily and disadvantageously be extinguished during a time when the polarity of the high-pressure discharge lamp is inverted in the A3 phase.

In another example as previously known in the art, referring to FIG. 15, an additional operating mode (i.e., an A2 phase) for lowering the operating frequency in a stepped manner is inserted between the A1 phase and the A3 phase to overcome insufficient heating of the electrodes of the high-pressure discharge lamp by increasing the lamp current Ila in the A2 phase. It is possible in such a manner to sufficiently heat the electrodes of the high-pressure discharge lamp and shift to the A3 phase in a stable arc discharge state. However, as shown in FIG. 16, since a time required to heat the electrodes of the high-pressure discharge lamp (for example, one second or more) is previously set as the A2 phase, when the high-pressure discharge lamp does not ignite in the A1 phase the A2 phase is unnecessary, and in fact undesirable, as a starting time of the high-pressure discharge lamp becomes longer. A high voltage, though lower than the voltage in the A1 phase, is further generated in the A2 phase while the discharge lamp remains unlit, and therefore stresses are undesirably exerted on various circuit components.

BRIEF SUMMARY OF THE INVENTION

Various embodiments of the present invention as described herein provide a high pressure discharge lamp ballast which can determine an output of the high-pressure discharge lamp before shifting from a starting mode to a steady-state operating mode, insert an operating mode for heating the electrodes and sufficiently heat the electrodes of the high-pressure discharge lamp when it is determined that the high-pressure discharge lamp has been ignited, thereby shifting the lamp to steady-state operation while in a stable arc discharge state.

In an embodiment of the present invention, an electronic ballast is provided for improved startup and powering of a high pressure discharge lamp. The ballast includes an inverter, a starting circuit for generating a high voltage to ignite the lamp, a controller for controlling an operating frequency of the inverter from startup to steady-state lamp operation, and a lamp output detection circuit. The controller controls the inverter in association with one or more of a first phase in which the starting circuit generates the high voltage and causes dielectric breakdown between the lamp electrodes, a second phase in which an electrode heating operation is performed after dielectric breakdown and a third phase in which steady-state operation of the lamp is performed. A lamp output determination is performed at a predetermined time before shifting to the third phase, and upon determining that the lamp is ignited the second phase is inserted.

FIGS. **9*a*-9*c*** are perspective view showing examples of various illumination fixtures using a high pressure discharge lamp ballast of the present invention.

Figure 10:
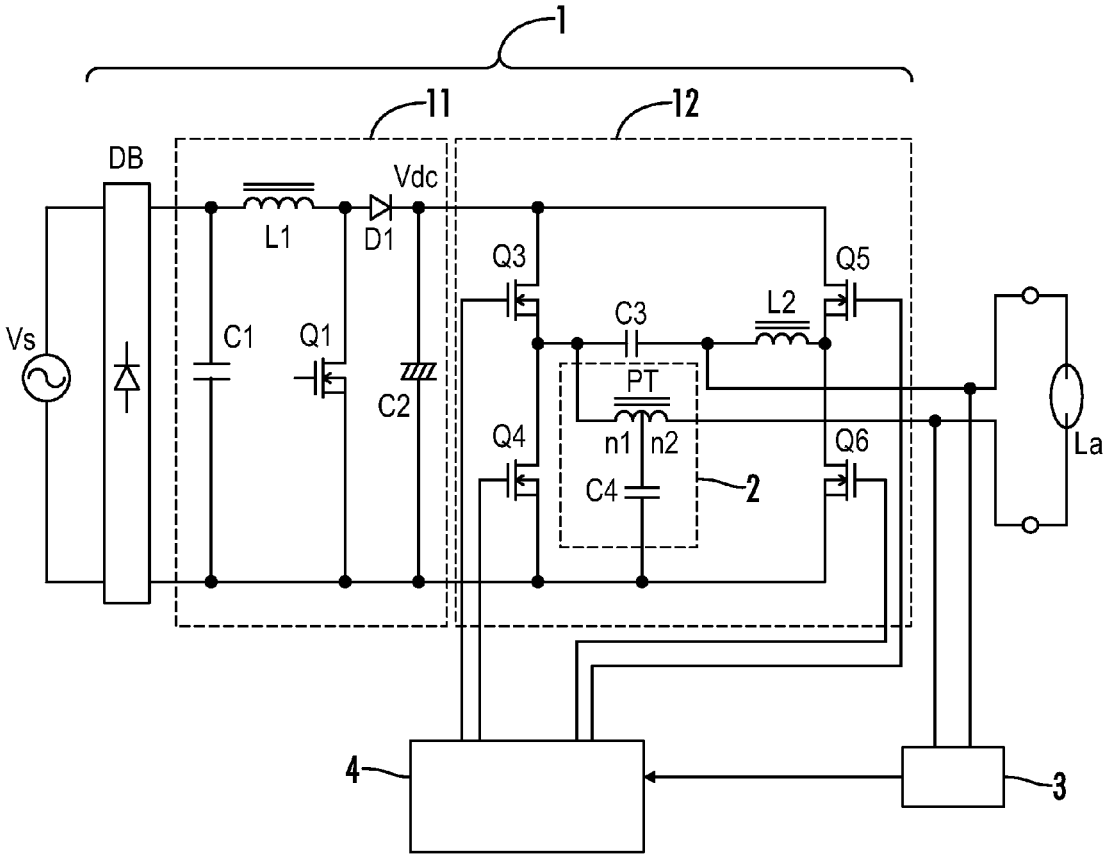
FIG. 10 (PRIOR ART)

FIG. 10 is a circuit diagram showing an electronic ballast configuration as previously known in the art.

Figure 11:
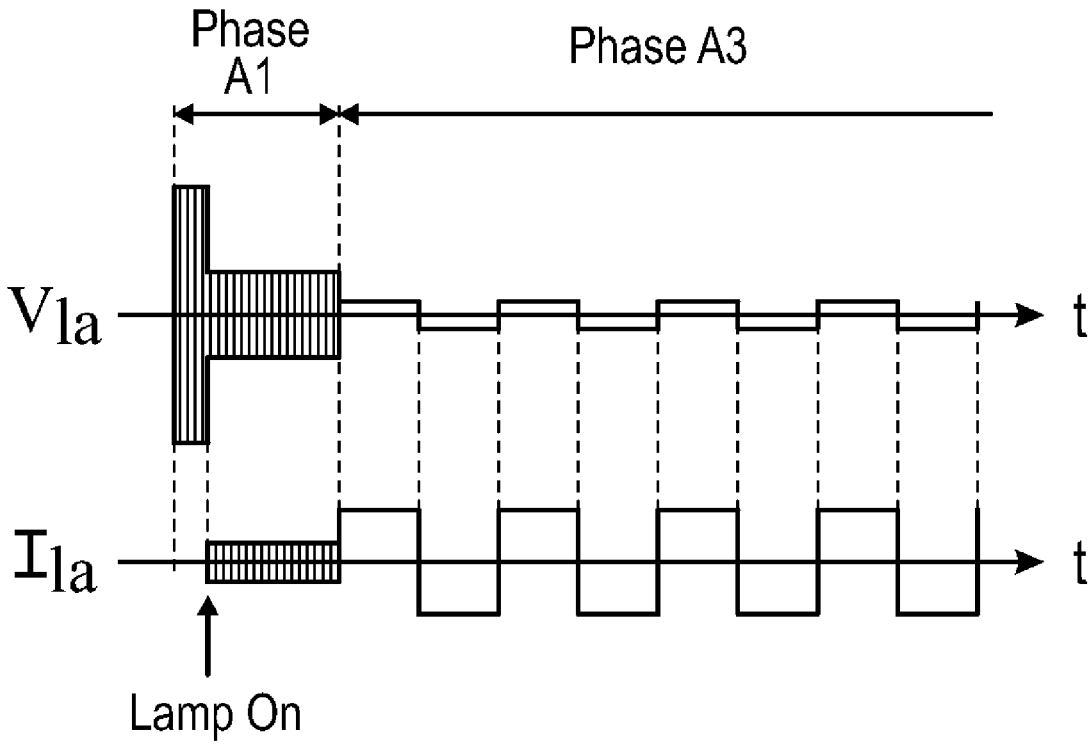
FIG. 11 (PRIOR ART)

FIG. 11 is a graphical diagram describing an operation of the ballast of FIG. 10.

Figure 12:
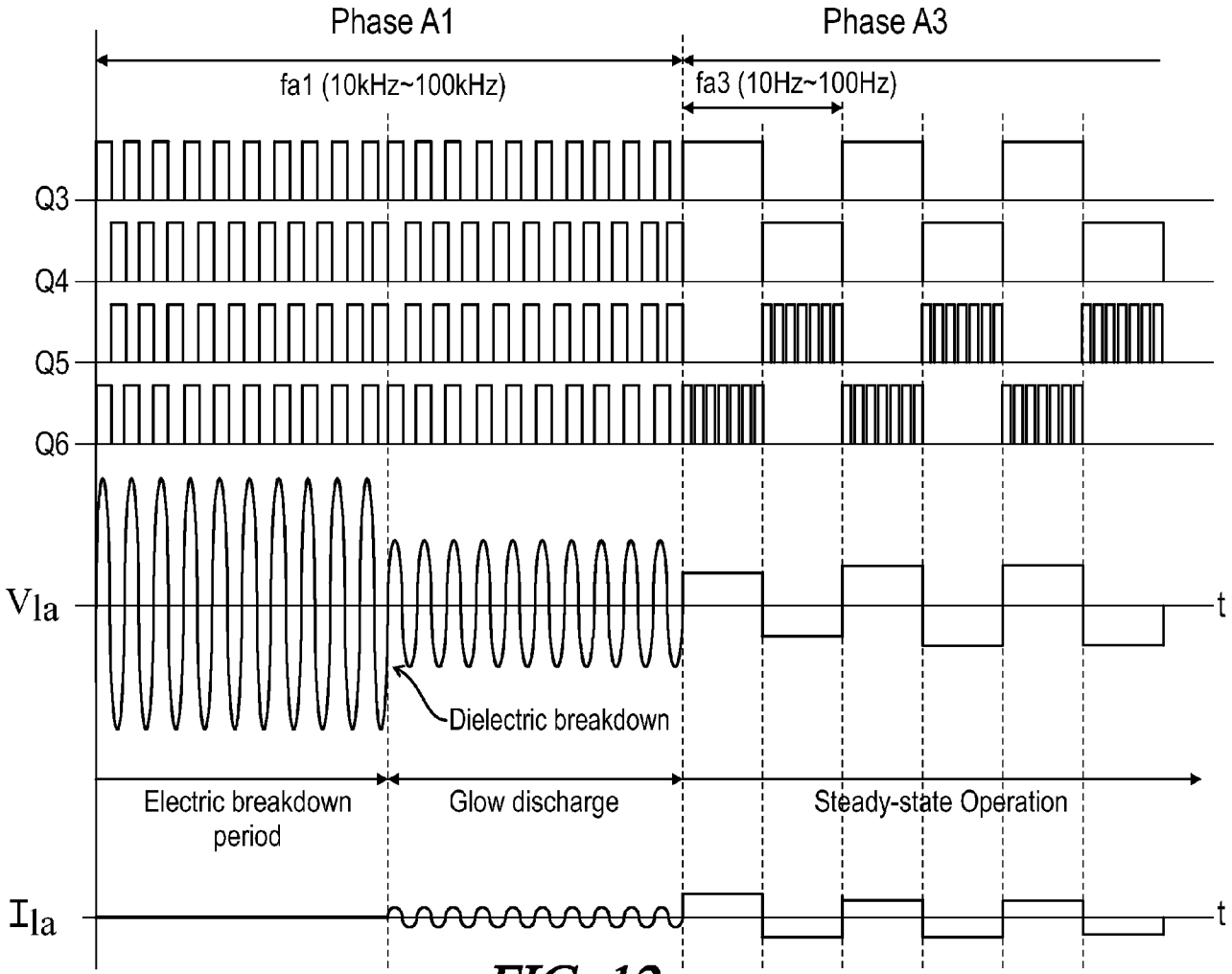
FIG. 12 (PRIOR ART)

FIG. 12 is a graphical diagram describing further operation of the ballast of FIG. 10.

Figure 13:
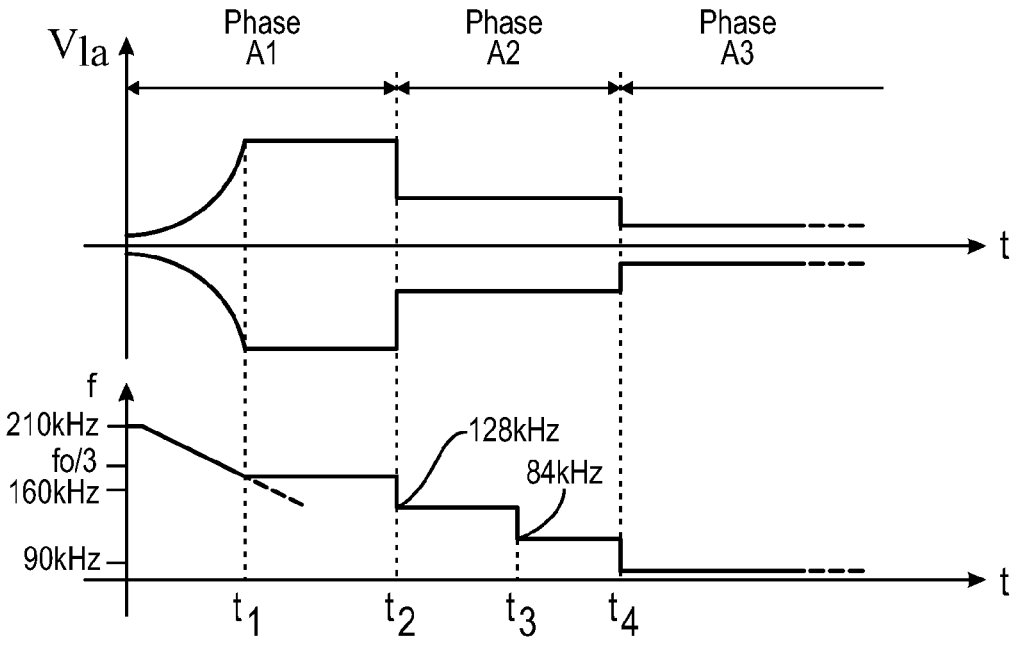
FIG. 13 (PRIOR ART)

FIG. 13 is a graphical diagram describing an operation in another example as previously known in the art.

Figure 14:
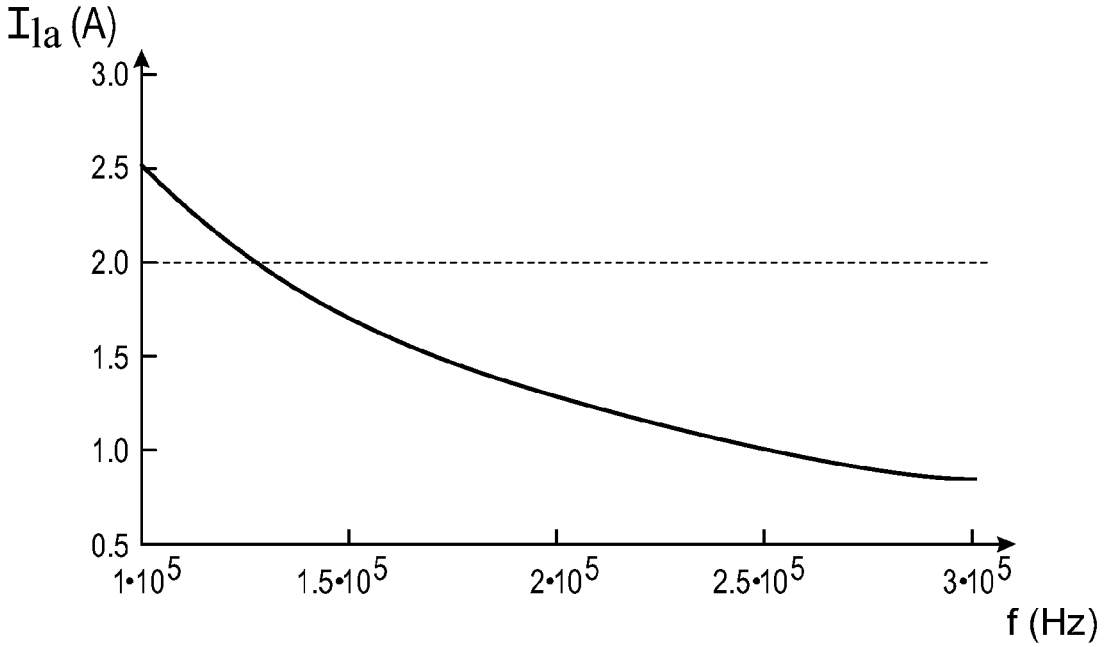
FIG. 14 (PRIOR ART)

FIG. 14 is a graphical diagram further describing operation in the example of FIG. 13.

Figure 15:
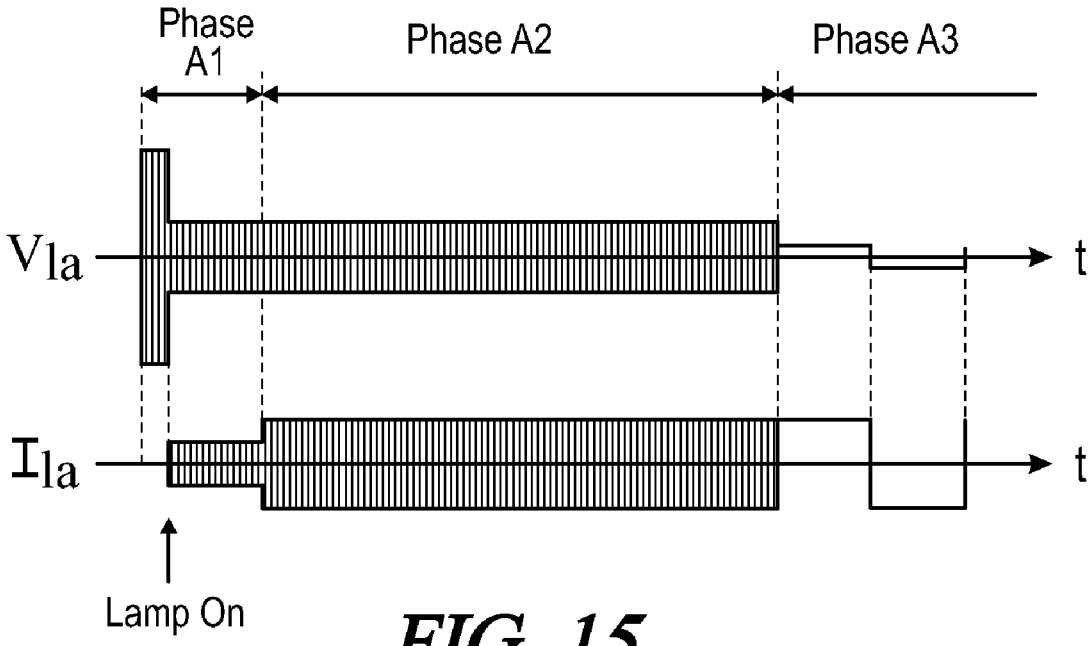
FIG. 15 (PRIOR ART)

FIG. 15 is a graphical diagram describing a problem in the example of FIG. 13.

Figure 16:
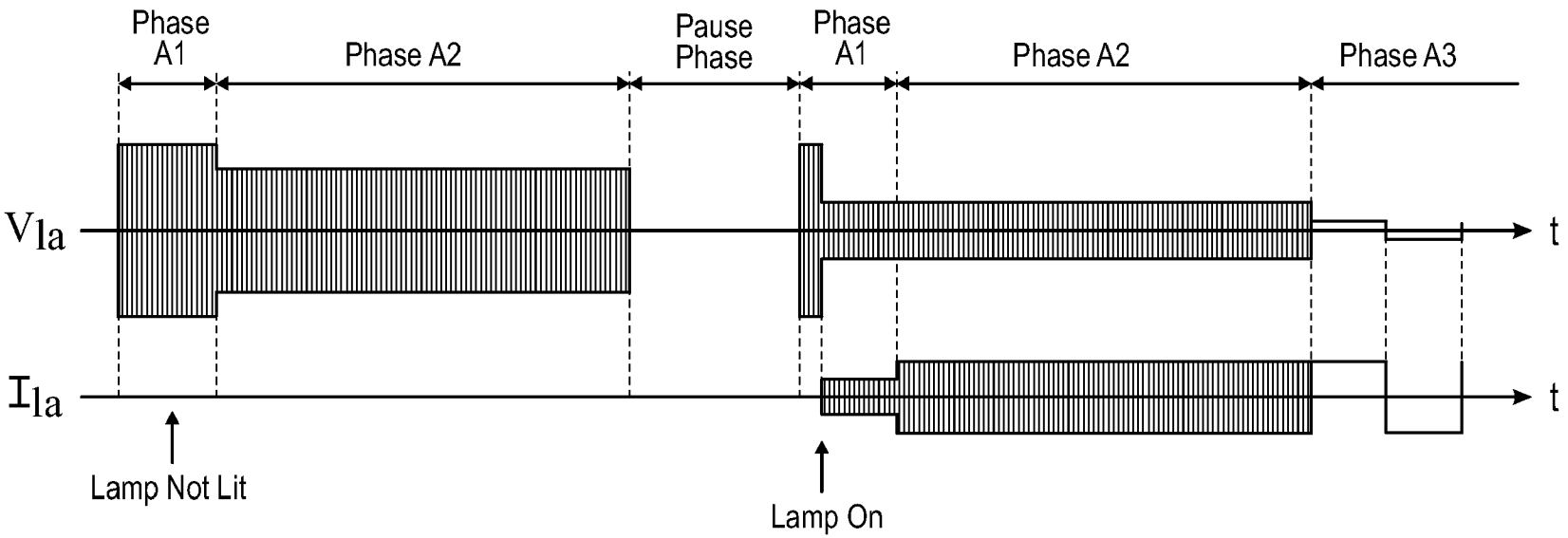
FIG. 16 (PRIOR ART)

FIG. 16 is a graphical diagram further describing the problem in the example of FIG. 13.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

In various embodiments of the present invention, an electronic ballast may be provided having a circuit structure substantially similar to that shown in FIG. 10 and as previously known in the art, with exceptions as further noted below, such as for example that the controller 4 of the present disclosure may further include an A2 transition control circuit 5.

Figure 1:
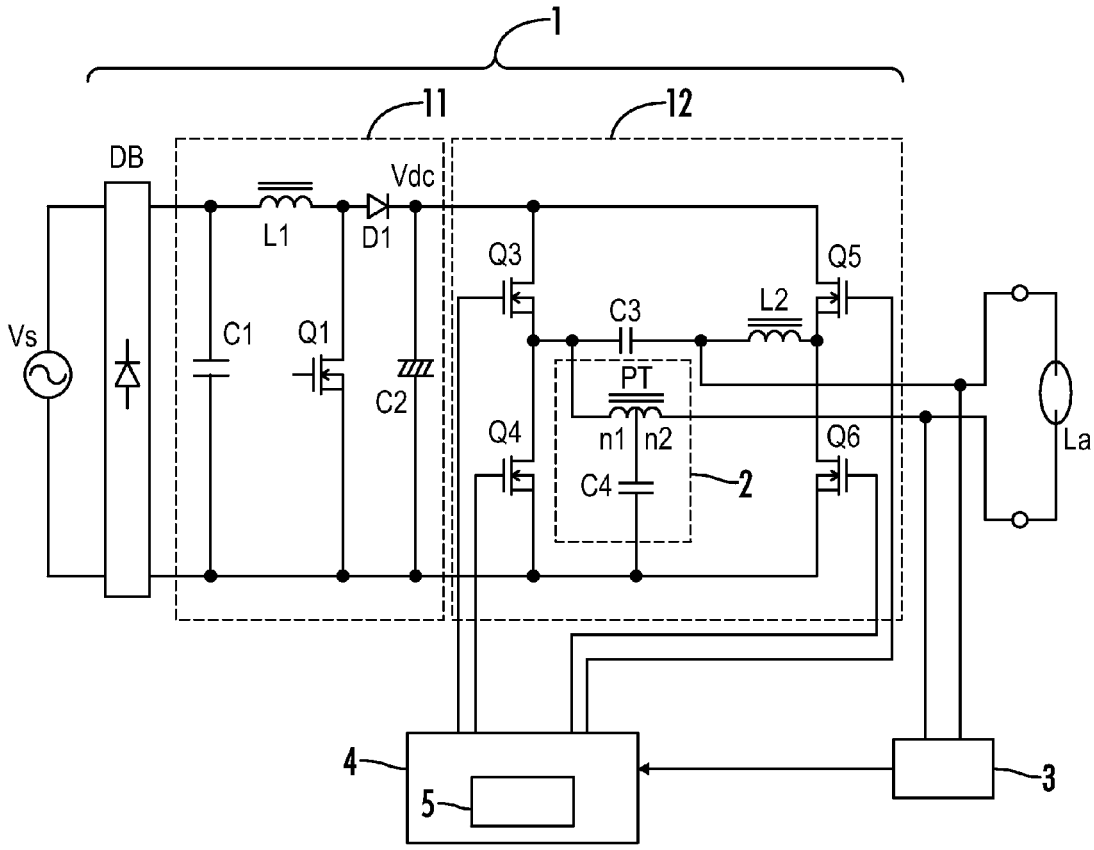
FIG. 1 is a circuit diagram of an embodiment of an electronic ballast of the present invention.

Referring to FIG. 1, in an embodiment of the present invention there may be provided a high pressure discharge lamp ballast having a DC power source (as shown an output from the power factor correction circuit 11), a power conversion circuit (inverter 12) for converting an output voltage Vdc of the DC power source into electric power required for a high-pressure discharge lamp DL to operate the high-pressure discharge lamp DL, a starting circuit 2 for generating a high voltage to ignite the high-pressure discharge lamp DL, a controller (switching element control circuit 4) for controlling the inverter from ignition to steady-state operation of the high-pressure discharge lamp DL and a lamp output detection circuit 3 for determining an operating state of the high-pressure discharge lamp DL.

The inverter 12 (as further shown in FIG. 2) may be controlled to operate in association with one or more of a first phase A1 (or operating mode A1) as a period in which the starting circuit 2 generates a high voltage for causing dielectric breakdown between electrodes of the high-pressure discharge lamp DL, a second phase A2 (or operating mode A2) as a period in which an operation of heating the electrodes of the high-pressure discharge lamp DL is performed after dielectric breakdown, and a third phase A3 (or operating mode A3) as a period in which a steady-state operation of powering the high-pressure discharge lamp DL is performed.

The lamp output detection circuit 3 may be configured to perform a determination operation at a predetermined point in time before shifting to the third phase A3, and when it is determined that the lamp has ignited, the second phase A2 is subsequently inserted.

The full-wave rectifying circuit DB in an embodiment as shown may be a diode bridge circuit coupled to a commercial AC power source Vs and which rectifies an AC voltage of the AC power source and outputs an undulating voltage. A filter circuit (not shown) for preventing high frequency leakage may in various embodiments be provided at an AC input terminal of the full-wave rectifying circuit DB.

The power factor correction circuit 11 receives the rectified output voltage provided by the full-wave rectifying circuit DB and outputs a boosted DC voltage Vdc. An input capacitor C1 is connected in parallel with an output terminal of the full-wave rectifying circuit DB, a series circuit formed of the inductor L1 and the switching element Q1 is connected to the output terminal of the full-wave rectifying circuit DB, and a smoothing capacitor C2 is connected across the switching element Q1 through a diode D1. By turning on/off the switching element Q1 with a frequency which is sufficiently higher than a commercial frequency of the commercial AC power source Vs, an output voltage of the full-wave rectifying circuit DB is boosted to the defined DC voltage Vdc and charged to the smoothing capacitor C2, and power factor improvement control is performed to give resistance to the circuit so that an input current and an input voltage from the commercial AC power source Vs may not be out of phase with each other.

The inverter circuit 12 is configured in an embodiment by connecting a filter circuit formed of an inductor L2 in series with a load and a capacitor C3 in parallel with the load to an output of a full bridge circuit formed of the switching elements Q3 to Q6. The high-pressure discharge lamp DL as the load is a high-intensity high-pressure discharge lamp (HID lamp) such as a metal halide lamp or a high-pressure mercury lamp. The switching elements Q3 to Q6 of the inverter 12 are controlled by the switching control circuit 4 in an operation as shown for example in FIG. 2.

Figure 2:
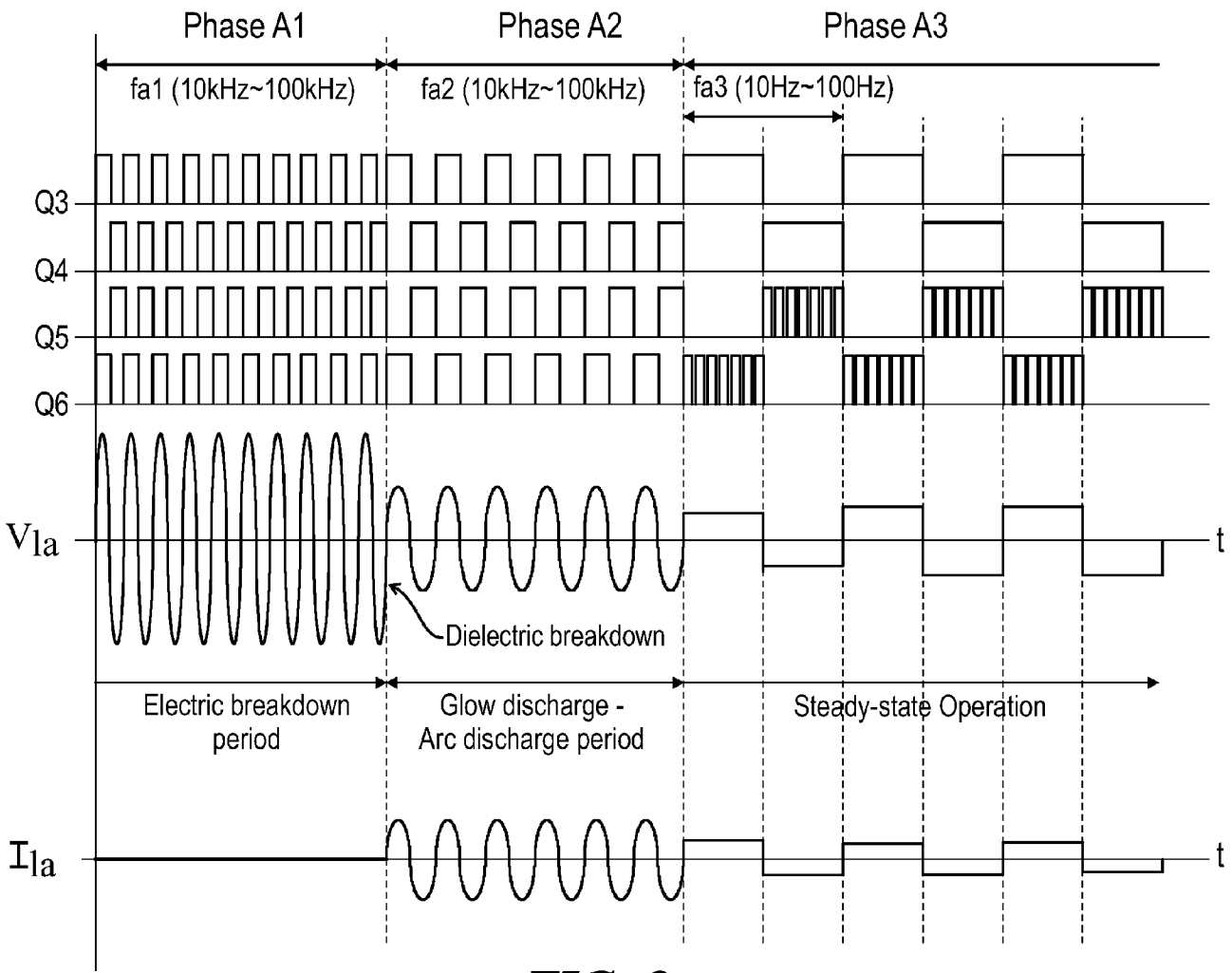
FIG. 2 is a graphical diagram describing an operation of the ballast of FIG. 1.

Referring to FIG. 2, an A1 phase as shown is a dielectric breakdown period (ignition mode), an A2 phase is a transition period from glow discharge to arc discharge after dielectric breakdown takes place (electrode heating mode) and an A3 phase is a normal operating period (steady-state mode). FIG. 2 shows an on/off operation of the switching elements Q3 to Q6, the lamp voltage Vla and the lamp current Ila of the high-pressure discharge lamp DL in association with each phase.

Controls in the A1 to A3 phases as shown in FIG. 2 may be sequentially performed by using the high pressure discharge lamp ballast in various embodiments such as shown for example in FIG. 1 until the high-pressure discharge lamp DL shifts from an unlit state to a stable operating state.

First, in the A1 phase, by supplying a high-frequency voltage generally proximate a resonance frequency or an integral sub-multiple thereof to the starting circuit 2 (as shown, a resonance boost circuit formed of a pulse transformer PT and a capacitor C4), a starting high voltage is supplied to the high-pressure discharge lamp DL as may be understood by one of skill in the art. In other words, as shown in FIG. 2, a state where the switching elements Q3, Q6 are turned on and the switching elements Q4, Q5 are turned off and a state where the switching elements Q3, Q6 are turned off and the switching elements Q4, Q5 are turned on alternate with each other at a frequency fa1 (a few dozens of kHz to a few hundreds of kHz). The frequency fa1 is swept about the resonance frequency (fo) of a primary winding n1 of a pulse transformer PT and the capacitor C2 in the starting circuit 2 or an integral sub-multiple of the resonance frequency fo (for example, fo/3). A resonance voltage is therefore generated at a primary winding n1 of the pulse transformer PT and boosted through a secondary winding n2 at a winding ratio of n1:n2, and the boosted voltage is applied across the electrodes of the high-pressure discharge lamp DL through the capacitor C3, thereby causing dielectric breakdown between the electrodes.

The controller 4 in an embodiment as shown in FIG. 1 includes an A2 transition control circuit 5 for controlling the transition from the A1 phase to the A2 phase. When it is determined that the high-pressure discharge lamp DL has ignited, according to a detection signal from the lamp output detection circuit 3 which operates in the A1 phase at all times, the A1 phase shifts to the A2 phase. Accordingly, the A1 phase in such an embodiment also functions as a lamp output determination phase.

By detecting the lamp voltage V1*a* of the high-pressure discharge lamp DL and monitoring changes in the lamp voltage V1*a*, the lamp output detection circuit 3 may be configured to determine the status of the high-pressure discharge lamp DL (i.e., lamp output). Alternatively, as other means to determine the lamp state, the current Ila flowing to the high-pressure discharge lamp DL may be detected.

In the A2 phase, as shown in FIG. 2, an operation may be performed where the switching elements Q3, Q6 are turned on and the switching element Q4, Q5 are turned off, alternating with an operation where the switching elements Q3, Q6 are turned off and the switching elements Q4, Q5 are turned on at a frequency fa2 (a few dozens of kHz to a few hundreds of kHz). The frequency fa2 is set to be lower than the frequency fa1 in the A1 phase. As shown in FIG. 2, in the A1 phase the lamp current Ila does not flow and an amplitude of the lamp voltage Vla is high, while in the A2 phase the lamp current Ila starts to flow and the amplitude of the lamp voltage Vla is lower than that in the A1 phase. In other words, when dielectric breakdown occurs between the electrodes due to the operation in the A1 phase, the high-pressure discharge lamp DL begins glow discharge. However, to uniformly raise the temperature of both electrodes of the high-pressure discharge lamp DL before glow discharge shifts to stable arc discharge, by providing a high-frequency current with operating frequency fa2 which is lower than the operating frequency fa1 in the A1 phase, an amplitude of the lamp current Ila is made higher than that in the example shown for example in FIG. 12. After the temperature of the electrodes is uniformly and sufficiently increased, glow discharge is shifted to stable arc discharge. In this manner, in the A2 phase as a transition between the A1 phase and the A3 phase, operation is performed with a high frequency which is lower than that in the A1 phase. The operating frequency fa2 in the A2 phase may be lowered in a stepped or continuous manner, as in the example previously described and as shown in FIG. 13.

In the A3 phase, a DC output of the power factor correction circuit 11 is converted into a low-frequency rectangular wave AC voltage, and the converted voltage is applied to the high-pressure discharge lamp DL. The inverter 12 alternately turns on/off the switching elements Q3, Q4 with a predetermined low frequency fa3 (a few dozens of Hz to a few hundreds of Hz), and at this time an operation is repeated of turning on/off the switching element Q6 with a predetermined frequency (a few dozens of kHz) while the switching element Q3 is turned on and turning on/off the switching element Q5 with a predetermined frequency (a few dozens of kHz) while the switching element Q4 is turned on. In this manner the low-frequency rectangular wave AC voltage is applied to the high-pressure discharge lamp DL. At this time, in an embodiment the capacitor C3 and the inductor L2 function as a filter circuit and an anti-parallel diode (body diode) built in the switching elements Q5, Q6 functions as a regenerative current energizing diode.

In the A3 phase, when steady-state operation has been achieved, or in other words after shifting to the arc discharge state, the lamp voltage Vla of the high-pressure discharge lamp DL gradually rises from a few volts to a rated voltage (a few dozens of volts to a few hundreds of volts) in a few minutes. When temperature in an arc tube rises to a stable state after the high-pressure discharge lamp DL has ignited and a few minutes have elapsed, the lamp voltage Vla of the high-pressure discharge lamp DL becomes substantially constant.

Figure 3:
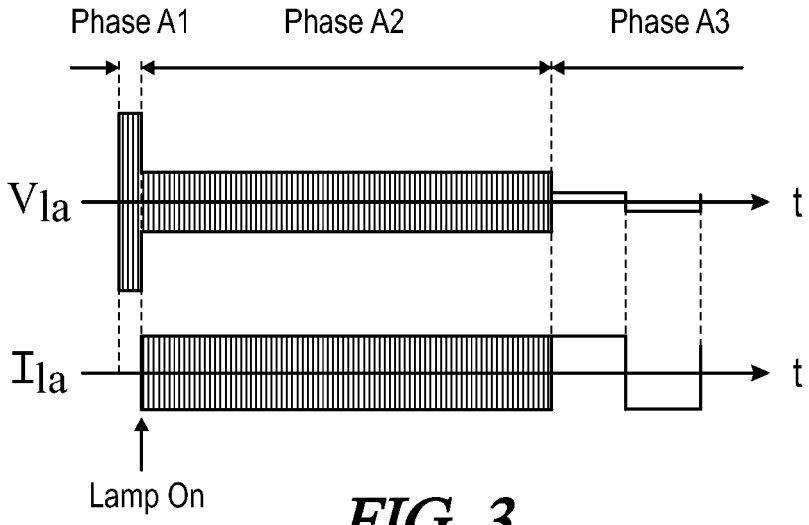
FIG. 3 is a graphical diagram describing an operation of the ballast of FIG. 1 where breakdown occurs in the A1 phase.
Figure 4:
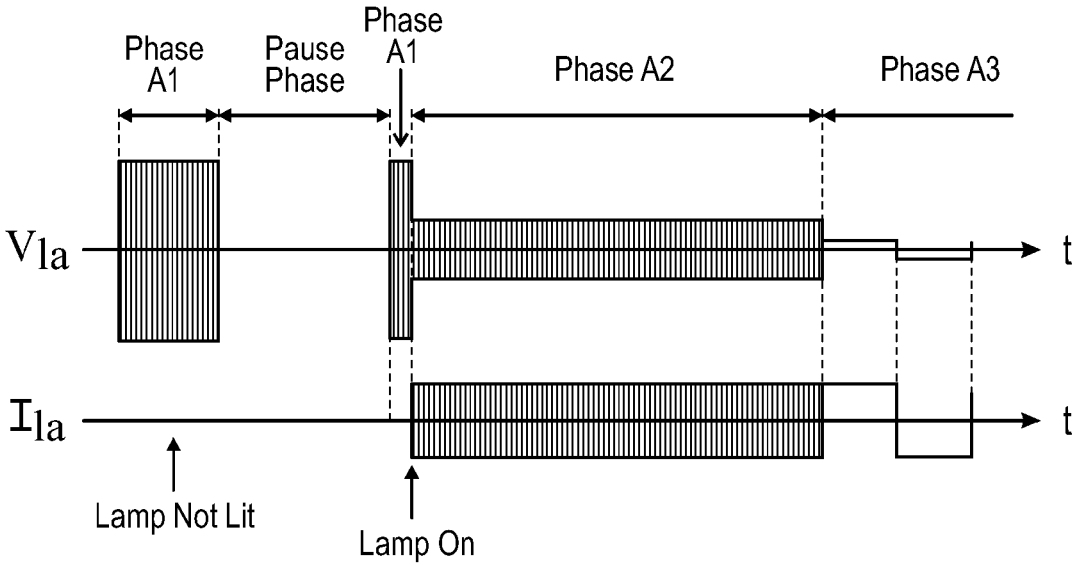
FIG. 4 is a graphical diagram describing an operation of the ballast of FIG. 1 where breakdown does not occur in the A1 phase.

FIG. 3 shows an example of operation in the case where dielectric breakdown occurs in the high-pressure discharge lamp DL in the first A1 phase after power-on, and FIG. 4 shows an example of operation in the case where dielectric breakdown does not occur in the high-pressure discharge lamp DL in the first A1 phase after power-on but instead occurs in a second A1 phase.

Referring first to FIG. 3, an exemplary relationship is shown between the lamp voltage Vla and the lamp current Ila of the high-pressure discharge lamp DL in a starting process in which dielectric breakdown occurs in the high-pressure discharge lamp DL in the first A1 phase, and a transitional sequence follows from the A1 phase to the A2 phase and then to the A3 phase. In the A1 phase, a starting high voltage is applied across the high-pressure discharge lamp DL, thereby causing dielectric breakdown. When it is determined that the high-pressure discharge lamp DL is ignited during the A1 phase, the A1 phase immediately shifts to the A2 phase to uniformly and sufficiently raise the temperature of both electrodes of the high-pressure discharge lamp DL and bring the lamp into the stable arc discharge state, after which transition is made to the A3 phase.

Comparing an exemplary operation in an embodiment of the present invention, as shown in FIG. 3, with an operation as previously known in the art as shown in FIG. 15, in the previously known and described operation an amplitude of the lamp current Ila during the remaining time period after dielectric breakdown in the A1 phase is relatively small and heating of the electrodes in this period is insufficient. Alternatively in an operation such as shown in FIG. 3, since a transition from the A1 phase to the A2 phase is made immediately after dielectric breakdown, amplitude of the lamp current Ila after dielectric breakdown is relatively large and the electrodes can be rapidly heated, thereby shifting from glow discharge to arc discharge. Therefore, according to the control operation as shown in the embodiment in FIG. 3, and as compared to the control operation as shown in FIG. 15 and previously known in the art, even when the amount of time in the A2 phase is equivalent, the time required for shifting to the A3 phase can be shortened, resulting in an overall reduction in the starting time.

Referring now to FIG. 4, a relationship may be described between the lamp voltage Vla and the lamp current Ila of the high-pressure discharge lamp DL in a starting process in which dielectric breakdown does not occur in the high-pressure discharge lamp DL in the first A1 phase after power-on, but instead occurs in a second A1 phase, after which the A1 phase shifts to the A2 phase and then the A3 phase.

As shown in FIG. 4, when it is determined that dielectric breakdown does not occur in the high-pressure discharge lamp DL in the first A1 phase after power-on and the high-pressure discharge lamp DL has not ignited even after a lapse of a predetermined time (a predetermined upper limit of duration of the A1 phase), the A1 phase may shift to a "pause" phase for a certain time and then proceeds to the second A1 phase. Upon determining that the high-pressure discharge lamp DL is ignited in the second A1 phase, as in the example shown in FIG. 3, the A1 phase immediately shifts to the A2 phase to uniformly and sufficiently raise the temperature of both electrodes of the high-pressure discharge lamp DL and put the lamp into the stable arc discharge state, and then transition is made to the A3 phase. Alternatively, the A1 phase may be restarted without first shifting to the pause phase, thereby causing dielectric breakdown in the high-pressure discharge lamp DL.

As described above, when the high-pressure discharge lamp DL is ignited in the A1 phase, the A1 phase can rapidly shift to the A2 phase for heating both electrodes of the high-pressure discharge lamp DL before the predetermined duration of the A1 phase has elapsed, so that the overall starting time can be shortened. When the high-pressure discharge lamp DL does not ignite during the A1 phase, since the A1 phase shifts instead to the pause phase without needlessly spending time equivalent to the A2 phase, the overall starting time can further be shortened, resulting in improved starting capability for the high-pressure discharge lamp.

Further, comparing an embodiment of the present invention as shown in FIG. 4 with an operation as previously known in the art and shown for example in FIG. 16, in the previously known example of FIG. 16 the output of the high-pressure discharge lamp DL is determined at the time of shifting to the A3 phase, even when dielectric breakdown does not occur in the high-pressure discharge lamp DL for the predetermined time in the A1 phase. A high-frequency operation is subsequently and needlessly performed in the A2 phase for a predetermined time. In the embodiment shown in FIG. 4, since the output state of the high-pressure discharge lamp DL is determined in the A1 phase, when dielectric breakdown occurs in the high-pressure discharge lamp DL for the predetermined time in the A1 phase, the A1 phase can immediately shift to the A2 phase, and conversely when dielectric breakdown does not occur in the high-pressure discharge lamp DL in the A1 phase for the predetermined time, the A1 phase can shift to the pause phase by omitting the redundant A2 phase.

Although in various embodiments operation in the A1 phase is a high-frequency operation of generating the resonance voltage, the operation may alternatively be obtained by superimposing a pulse voltage on a DC operation or a low-frequency operation.

Similarly, although in various embodiments the operation in the A2 phase is also a high-frequency operation, the operation may alternatively be the DC operation or the low-frequency operation.

Although in various embodiments the operation in the A3 phase is a low-frequency rectangular wave operation, the operation may alternatively be the DC operation or the high-frequency operation as long as the high-pressure discharge lamp maintains a normal or otherwise stable lighting operation.

Figure 5:
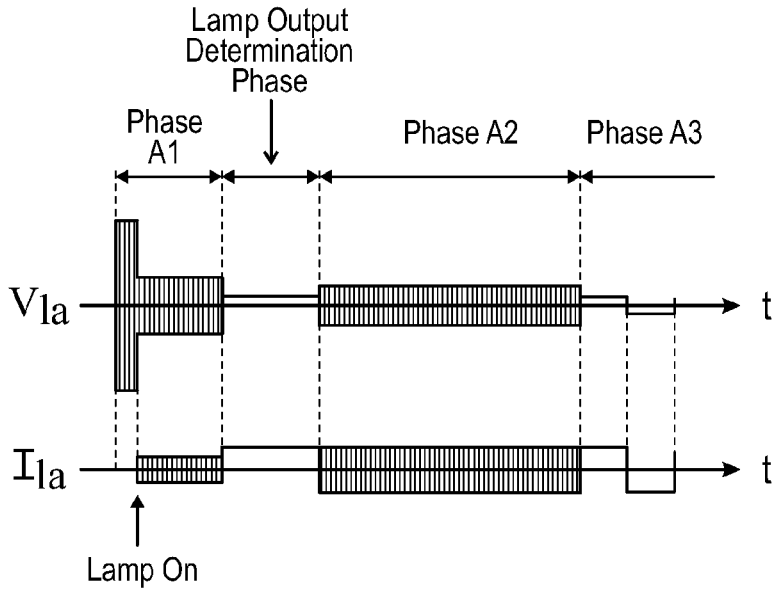
FIG. 5 is a graphical diagram describing another embodiment of an operation of the ballast of FIG. 1.

Referring now to FIG. 5, in another embodiment a circuit configuration may be provided having substantially the same structure as that in FIG. 1. FIG. 5 shows a relationship between the lamp voltage Vla and the lamp current Ila of the high-pressure discharge lamp DL during a starting process in which, after dielectric breakdown occurs in the high-pressure discharge lamp DL in the A1 phase after power-on, through the lamp output determination phase for a predetermined time, the A1 phase shifts to the A2 phase and then the A3 phase.

The A1 phase may also function as the lamp output determination phase in various embodiments, while alternatively a certain time after termination of a predetermined time for the A1 phase may be the lighting determination phase. When ignition is determined during the DC operation of the lamp output determination phase as shown in FIG. 5, rather than in the high-frequency operation of the high-frequency operation, since a high voltage is not generated at an output of the lighting circuit 1, circuit components such as for example the lamp output detection circuit 3 can be configured at low costs.

Furthermore, since an electrode heating current can be provided in a lamp output determination phase for performing the DC operation, compared to the A1 phase for performing the high-frequency operation, the lamp output determination phase can be made a preliminary heating phase prior to a transition to the A2 phase, resulting in further improvements to the ballast with respect to startup.

Although the operation performed in the lamp output determination phase is the DC operation in an embodiment as shown in FIG. 5, it may be a low-frequency rectangular wave operation using DC operations for determining the lamp output of the high-pressure discharge lamp DL at both positive and negative polarities in respective half cycles. In this case, the lamp output determination phase (DC operation) in FIG. 5 is replaced with the low-frequency rectangular wave operation.

Figure 6:
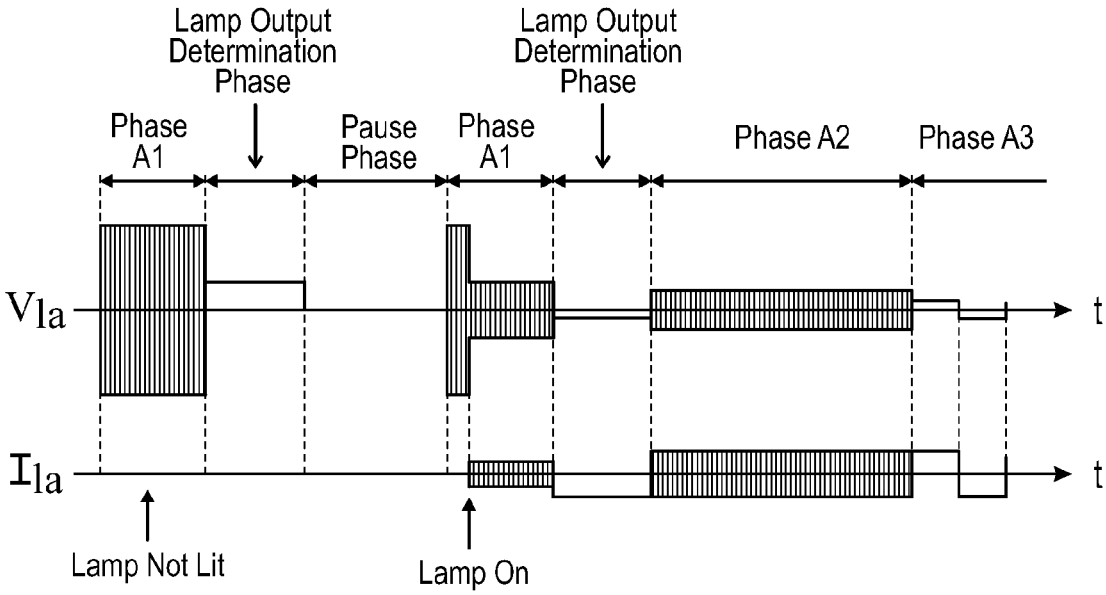
FIG. 6 is a graphical diagram describing another embodiment of an operation of the ballast of FIG. 1.

Referring now to FIG. 6, another embodiment of operation may be described for an electronic ballast having a circuit configuration substantially the same as that in FIG. 1, characterized in that the polarity of the high-pressure discharge lamp DL is alternately determined in the lamp output determination phase (DC operation). In the example shown in FIG. 6, when the lamp current Ila is not detected in the first lamp output determination phase (DC operation in which the lamp voltage Vla has a positive polarity) and the lamp is determined to be in an unlit state, the A1 phase proceeds to a second A1 phase via a predetermined pause phase. When the lamp current Ila is detected in the second lamp output determination phase (DC operation in which the lamp voltage Vla has a negative polarity), the A1 phase shifts to the A2 phase.

As described above, by alternately inverting the polarity of the high-pressure discharge lamp DL in the lamp output determination phase, and in the case where the polarity in which the high-pressure discharge lamp is easily ignited varies depending on the type or state of the high-pressure discharge lamp, the ability of the ballast to ignite the lamp is thereby improved by shifting to the A2 phase from not only the same polarity, but also the polarity at which the high-pressure discharge lamp is easily ignited.

The lamp output detection circuit 3 for determining an ignited/unlit state of the high-pressure discharge lamp DL may be for example a circuit for determining the lamp voltage Vla or a characteristic relating to the lamp voltage Vla, or a circuit for determining the lamp current Ila or a characteristic relating to the lamp current Ila.

In the example shown in FIG. 6, by determining whether an absolute value of the lamp voltage Vla in the lamp output determination phase is larger or smaller than a reference value for lamp output determination, lamp ignition can be determined. Alternately, by determining the presence or absence of lamp current Ila during the lamp output determination phase, lamp ignition can be determined.

Figure 7:
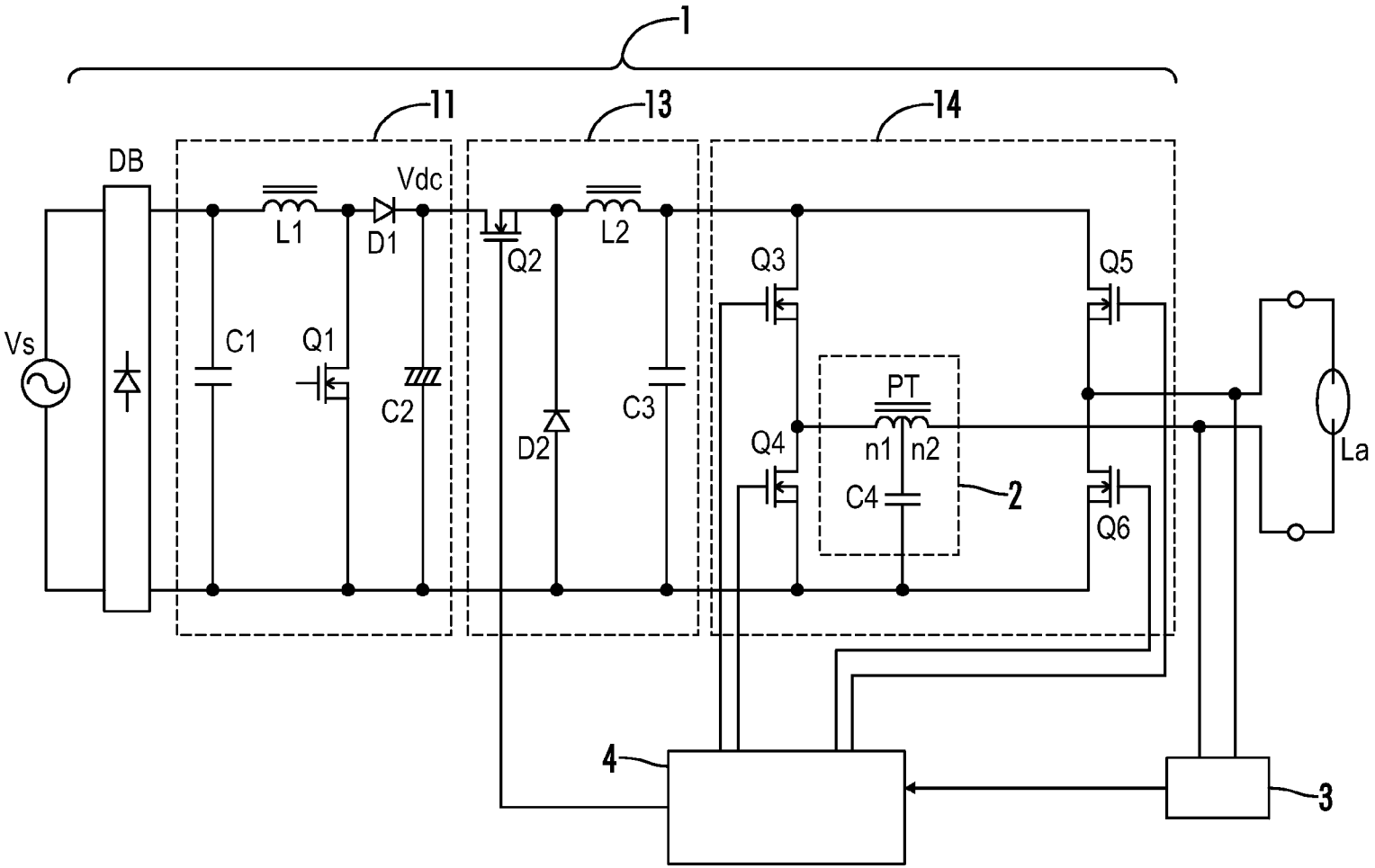
FIG. 7 is a circuit diagram of another embodiment of a ballast of the present invention.

Referring now to FIG. 7, in an embodiment of the present invention a functionality of the inverter circuit 12 in embodiments as shown in FIG. 1 is obtained by combining of a separate step-down chopper circuit 13 and a polarity inversion circuit 14.

The step-down chopper circuit 13 in such an embodiment supplies a target power to the high-pressure discharge lamp DL as the load. An output voltage of the step-down chopper circuit 13 is variably controlled by the switching control circuit 4 so that appropriate power is supplied to the high-pressure discharge lamp DL from startup to steady-state via the arc discharge shift period.

An exemplary circuit configuration of the step-down chopper circuit 13 may be described. A positive electrode of the smoothing capacitor C2 as the DC power source is connected to a positive electrode of the capacitor C3 through the switching element Q2 and the inductor L2, and a negative electrode of the capacitor C3 is connected to a negative electrode of the smoothing capacitor C2. An anode of a regenerative current energizing diode D2 is connected to the negative electrode of the capacitor C3, and a cathode of the diode D2 is connected to a connection point of the switching element Q2 and the inductor L2.

Operation of the step-down chopper circuit 13 may now be described. The switching element Q2 is turned on/off with a high frequency by the output of the switching control circuit 4, a current flows from the smoothing capacitor C2 as the DC power source through the switching element Q2, the inductor L2 and the capacitor C3 while the switching element Q2 is turned on and a regenerative current flows through the inductor L2, the capacitor C3 and the diode D2 while the switching element Q2 is turned off. Thereby, a DC voltage obtained by lowering the DC voltage Vdc is charged to the capacitor C3. The voltage obtained by the capacitor C3 can be variably controlled by varying an ON duty (ratio of an ON time in one cycle) of the switching element Q2.

The polarity inversion circuit 14 (or simply inverter 14) is connected to an output of the step-down chopper circuit 13. The polarity inversion circuit 14 is a full bridge circuit formed of the switching elements Q3 to Q6, and a pair of the switching elements Q3, Q6 and a pair of the switching elements Q4, Q5 are alternately turned on with a high frequency at startup and with a low frequency during normal operation according to a control signal from the switching control circuit 4, thereby converting output power of the step-down chopper circuit 13 into rectangular wave AC power and supplying the converted power to the high-pressure discharge lamp DL.

The operational waveform for embodiments so described may be substantially the same as that in FIG. 2, with an exception being that the operation of the switching elements Q5, Q6 in the A3 phase is not high-frequency operation but a low-frequency operation in sync with the switching elements Q4, Q3. The A1 phase and the A2 phase may be substantially the same as those in FIG. 2.

Figure 8:
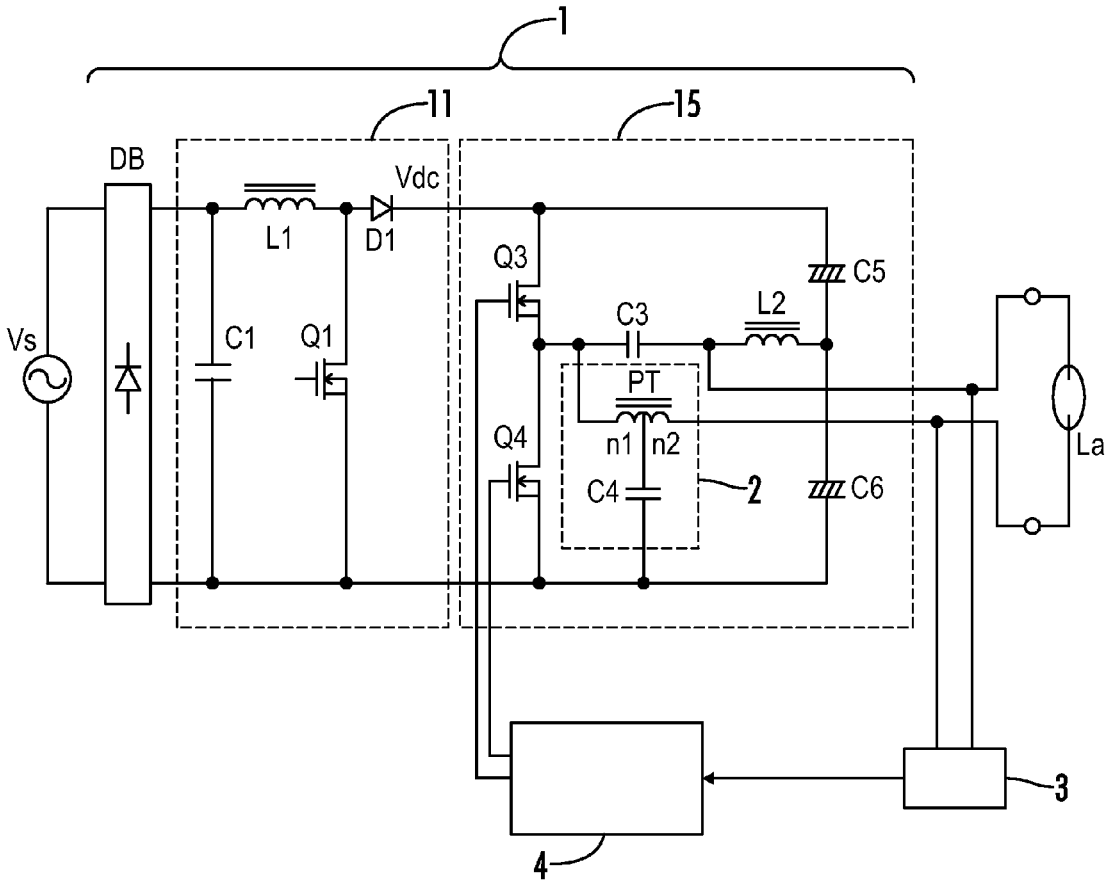
FIG. 8 is a circuit diagram of another embodiment of a ballast of the present invention.

Referring now to FIG. 8, in another embodiment of the inverter 12 as shown in FIG. 1, the switching elements Q5, Q6 are replaced with capacitors C5, C6 and a half bridge circuit 15 is used in place of the full bridge circuit. The operational waveform in an embodiment so described is different from that in FIG. 2 in that control signals for the switching elements Q5, Q6 are used as control signals for the switching elements Q3, Q4 in FIG. 8 and an operating frequency is set to a frequency which does not resonate the starting circuit 2 in the A3 phase.

As a matter of course, in embodiments of a circuit configuration as shown in for example FIGS. 7-8, similar effects can be obtained according to the control similar to that in previously described embodiments as may be understood by one of skill in the art.

Figure 9A:
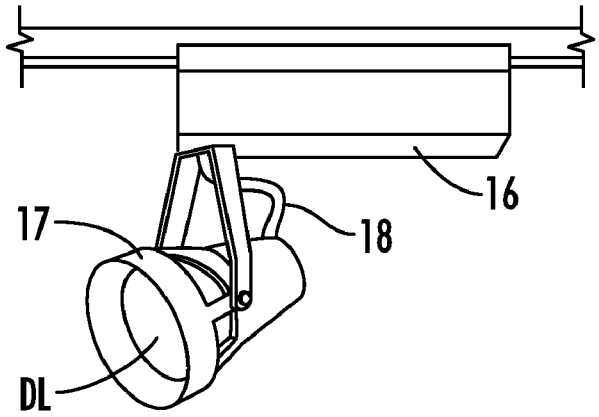
Figure 9B:
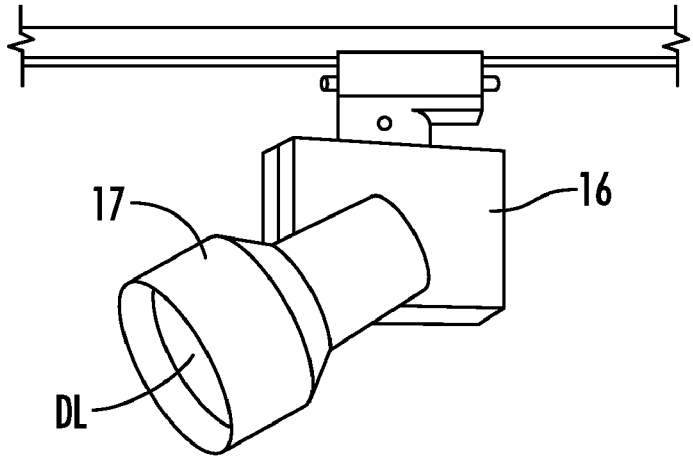
Figure 9C:
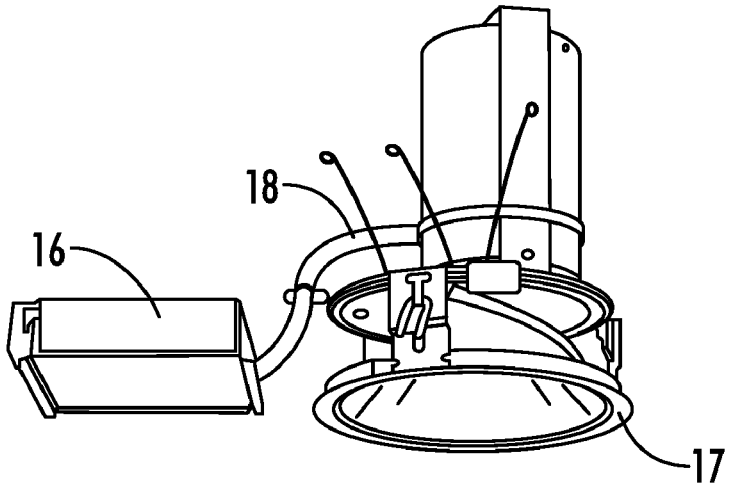

Referring now to FIG. 9, examples are shown of illumination fixtures using an embodiment of the high pressure discharge lamp ballast of the present invention. In the figure, DL refers to the high-pressure discharge lamp, 16 refers to a ballast housing which stores circuitry of the ballast as described herein, 17 refers to a lamp housing to which the high-pressure discharge lamp DL is attached and 18 refers to a connection wire. FIGS. 9(*a*), (*b*) show an example in which the high-pressure discharge lamp is used as a spotlight and FIG. 9(*c*) shows an example in which the high-pressure discharge lamp is used as a downright.

By using the above-mentioned high pressure discharge lamp ballast in these illumination fixtures, the ignited high-pressure discharge lamp can be reliably put into an arc discharge state, and even in the unlit high-pressure discharge lamp the overall starting time can be shortened as much as possible, resulting in improvements in the ability of the high-pressure discharge lamp to startup and operate in steady-state.

A plurality of such illumination fixtures may be combined to each other to configure an illumination system.

Thus, although there have been described particular embodiments of the present invention of a new and useful HID Lamp Ballast with Multi-Phase Operation Based on a Detected Lamp Output, it is not intended that such references be construed as limitations upon the scope of this invention except as set forth in the following claims.

What is claimed is:

1. A high pressure discharge lamp ballast comprising:

a DC power source;

an inverter effective to convert an output voltage of the DC power source into electric power required to power a high-pressure discharge lamp;

a starting circuit effective to generate a high voltage to ignite the high-pressure discharge lamp;

a controller effective to control the inverter from startup to steady-state operation of the high-pressure discharge lamp; and a lamp output detection circuit effective to provide a signal indicative of a lamp output for the high-pressure discharge lamp, wherein the controller controls the inverter in association with one or more of a first phase in which the starting circuit generates the high voltage for causing dielectric breakdown between electrodes of the high-pressure discharge lamp, a second phase in which an operation of heating the electrodes of the high-pressure discharge lamp is performed after dielectric breakdown and a third phase in which steady-state operation of the high-pressure discharge lamp is performed;

wherein a lamp output determination is performed at a predetermined time before shifting to the third phase, and upon determining that the lamp is ignited the second phase is inserted; and wherein upon determining that the lamp has not ignited based on the detected lamp output, the first phase shifts to a phase other than the second phase.

2. The high pressure discharge lamp ballast according to claim 1, wherein the operation in the third phase is a low-frequency rectangular wave operation.

3. The high pressure discharge lamp ballast according to claim 1, wherein the lamp output determination is performed during the first phase.

4. The high pressure discharge lamp ballast according to claim 3, wherein the first phase is a high-frequency operating period.

5. The high pressure discharge lamp ballast according to claim 1, wherein the lamp output determination is performed after termination of the first phase.

6. The high pressure discharge lamp ballast according to claim 5, wherein the lamp output determination is performed after termination of the first phase in a low-frequency operating period.

7. The high pressure discharge lamp ballast according to claim 6, wherein the low-frequency operating period is at least a half cycle or longer.

8. The high pressure discharge lamp ballast according to claim 7, wherein a single polarity of the high-pressure discharge lamp is used to determine the lamp output.

9. The high pressure discharge lamp ballast according to claim 7, wherein both polarities of the high-pressure discharge lamp are used to determine the lamp output.

10. The high pressure discharge lamp ballast according to claim 1, wherein upon determining that the lamp has not ignited based on the detected lamp output, the first phase shifts to repeat the first phase.

11. The high pressure discharge lamp ballast according to claim 1, wherein upon determining that the lamp has not ignited based on the detected lamp output, the first phase shifts to a pause phase.

12. An illumination fixture comprising a lamp housing shaped to receive a high pressure discharge lamp;

a ballast housing; and a high pressure discharge lamp ballast positioned within the ballast housing, the ballast further comprising an inverter further comprising a plurality of switching elements;

a starting circuit effective to generate a high starting voltage at a resonant frequency or an integral sub-multiple thereof;

a switching control circuit; and a lamp output detection circuit effective to provide a signal indicative of dielectric breakdown between electrodes in the lamp, wherein the controller controls the inverter in association with one or more of a first phase in which the starting circuit generates the high voltage for causing the dielectric breakdown, a second phase in which an operation of heating the lamp electrodes is performed after detection of dielectric breakdown by the lamp output detection circuit, a third phase in which steady-state operation of the high-pressure discharge lamp is performed; and wherein upon determining that dielectric breakdown has not occurred based on the lamp output detection signal, the first phase shifts to a phase other than the second phase.

13. The lighting fixture of claim 12, wherein the determination of dielectric breakdown is performed during the first phase.

14. The lighting fixture of claim 12, wherein the determination of dielectric breakdown is performed after termination of the first phase.

15. The lighting fixture of claim 12, wherein upon determining that dielectric breakdown has not occurred based on the lamp output detection signal, the first phase shifts to repeat the first phase.

16. The lighting fixture of claim 12, wherein upon determining that dielectric breakdown has not occurred based on the lamp output detection signal, the first phase shifts to a pause phase.

* * * * *